US010507367B2

(12) United States Patent
Gray et al.

(10) Patent No.: US 10,507,367 B2
(45) Date of Patent: Dec. 17, 2019

(54) BAT WITH BARREL PIVOT JOINT

(71) Applicant: Wilson Sporting Goods Co., Chicago, IL (US)

(72) Inventors: Adam G. Gray, Roseville, CA (US); James M. Earley, Roseville, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 85 days.

(21) Appl. No.: 15/166,427

(22) Filed: May 27, 2016

(65) Prior Publication Data

US 2017/0340935 A1 Nov. 30, 2017

(51) Int. Cl.

| | |
|---|---|
| ***A63B 59/50*** | (2015.01) |
| ***A63B 60/54*** | (2015.01) |
| ***A63B 60/00*** | (2015.01) |
| ***A63B 102/18*** | (2015.01) |

(52) U.S. Cl.

CPC ..... *A63B 59/50* (2015.10); *A63B 60/54* (2015.10); *A63B 2060/0081* (2015.10); *A63B 2102/18* (2015.10); *A63B 2102/182* (2015.10)

(58) Field of Classification Search

CPC ..... A63B 59/56; A63B 59/00

See application file for complete search history.

(56) References Cited

U.S. PATENT DOCUMENTS

| | | | |
|---|---|---|---|
| 1,499,128 | A | 6/1924 | Shroyer |
| 3,116,926 | A | 1/1964 | Owen |
| 3,392,976 | A | 7/1968 | Hayes |
| 4,128,242 | A | 12/1978 | Elkins, Jr. |
| 4,274,631 | A | 6/1981 | Hayazaki |
| 4,898,386 | A | 2/1990 | Anderson |
| 4,951,948 | A | 8/1990 | Peng |
| 5,080,363 | A | 1/1992 | Soong |
| 5,219,164 | A | 6/1993 | Peng |
| 5,277,421 | A | 1/1994 | Rewolinski |
| 5,393,055 | A | 2/1995 | MacKay, Jr. |
| 5,511,777 | A | 4/1996 | McNeely |
| 5,590,875 | A | 1/1997 | Young |
| 6,077,178 | A | 6/2000 | Brand |
| 6,530,852 | B2 | 3/2003 | Rios |
| 6,767,299 | B1 | 7/2004 | Chang |
| 6,783,471 | B2 | 8/2004 | Bolduc et al. |
| 6,875,137 | B2 | 4/2005 | Forsythe et al. |
| 6,905,429 | B2 | 6/2005 | Forsythe et al. |
| 7,014,580 | B2 | 3/2006 | Forsythe et al. |
| 7,044,871 | B2 | 5/2006 | Sutherland et al. |
| 7,052,419 | B2 | 5/2006 | Chang |
| 7,053,419 | B1 | 5/2006 | Camras et al. |
| 7,140,988 | B1 | 11/2006 | Hinman |
| 7,166,046 | B1 | 1/2007 | Liu |
| 7,201,679 | B2 | 4/2007 | Nguyen |

(Continued)

*Primary Examiner* — Jeffrey S Vanderveen

(74) *Attorney, Agent, or Firm* — Terence P. O'Brien; Todd A. Rathe

(57) ABSTRACT

A ball bat extending along a longitudinal axis. The bat includes a handle portion, a barrel portion and an end cap. The barrel portion includes a proximal region and a distal region. The proximal region of the barrel portion is coupled to the handle portion by a first pivot joint. The distal region of the barrel portion is coupled to the end cap by a second pivot joint. The first and second pivot joints movably support the barrel portion relative to the longitudinal axis.

21 Claims, 6 Drawing Sheets

(56) References Cited

U.S. PATENT DOCUMENTS

| | | | | |
|---|---|---|---|---|
| 7,267,619 | B1 | 9/2007 | Pettis | |
| 7,311,620 | B1 | 12/2007 | Heald et al. | |
| 7,399,242 | B1 | 7/2008 | Smith | |
| 7,572,197 | B2 | 8/2009 | Chauvin et al. | |
| 7,980,970 | B2 | 7/2011 | Watari et al. | |
| 8,226,505 | B2 | 7/2012 | Burger | |
| 8,632,428 | B2 | 1/2014 | Burger | |
| 8,888,614 | B2 | 11/2014 | Nutter | |
| 9,669,277 | B1 | 6/2017 | Haas et al. | |
| 9,814,956 | B2 | 11/2017 | Burger et al. | |
| 2002/0094892 | A1 | 7/2002 | Chauvin et al. | |
| 2003/0013563 | A1* | 1/2003 | Ryan | A63B 69/0002 473/457 |
| 2005/0143203 | A1 | 6/2005 | Souders et al. | |
| 2007/0155546 | A1* | 7/2007 | Chauvin | A63B 59/00 473/520 |
| 2011/0111892 | A1 | 5/2011 | Thouin et al. | |
| 2011/0111894 | A1 | 5/2011 | Thouin | |
| 2011/0172038 | A1 | 7/2011 | Watari et al. | |
| 2014/0080641 | A1 | 3/2014 | Epling et al. | |
| 2014/0080642 | A1 | 3/2014 | Epling et al. | |
| 2014/0206483 | A1 | 7/2014 | Goodwin et al. | |
| 2014/0221137 | A1 | 8/2014 | Krysiak et al. | |
| 2014/0274491 | A1 | 9/2014 | Long et al. | |
| 2014/0274493 | A1 | 9/2014 | Heussner | |
| 2015/0182771 | A1 | 7/2015 | Sillik | |
| 2016/0096092 | A1* | 4/2016 | Williams | A63B 59/20 473/564 |

* cited by examiner

BAT WITH BARREL PIVOT JOINT

FIELD OF THE INVENTION

The present invention relates to the use of one or more pivot joints in association with a barrel portion of a ball bat.

BACKGROUND

Baseball and softball are very popular sports in the United States, Japan, Cuba, and elsewhere. Ball bats impart or receive impact forces upon impacting a ball and transmit the shock and vibrations from the impact through the handle of the bat to the hands of the batter. Impacts occurring away from the "sweet spot" of the ball bat generally result greater shock and vibrational energy transferring to the batters hands. Many batters find such shock and/or vibrational energy to be uncomfortable and/or painful. Some players refer to this event as being "stung" by the bat. The fear of pain or discomfort upon hitting a ball away from the "sweet spot" can negatively affects a batter's performance, particularly many younger players.

Baseball and softball organizations periodically publish and update equipment standards and/or requirements including performance limitations for ball bats. It is not uncommon for ball bat manufacturers to adjust the design and/or construction of their ball bats to ensure that such bats satisfy the new or updated standards. As a result, the maximum performance level of high end ball bats used in organized, competitive play are designed not to exceed applicable performance limits. Many ball bat manufacturers seek to provide ball bat designs and/or constructions that provide a near maximum performance levels across a larger area or region of the bat barrel.

Accordingly, a continuing need exists for an improved ball bat that reduces the amount of shock and/or vibrational energy from a ball impact being transmitted to the batter's hands. What is also desired is a high performance ball bat that satisfies applicable maximum performance rules and/or standards and also provides near maximum performance along a greater region of the bat barrel.

SUMMARY OF THE INVENTION

The present invention provides a ball bat extending along a longitudinal axis. The bat includes a handle portion, a barrel portion and an end cap. The barrel portion includes a proximal region and a distal region. The proximal region of the barrel portion is coupled to the handle portion by a first pivot joint. The distal region of the barrel portion is coupled to the end cap by a second pivot joint. The first and second pivot joints movably support the barrel portion relative to the longitudinal axis.

According to one implementation of the invention, a ball bat for impacting a ball includes a barrel portion coupled to, and extending from, a handle portion and an end cap. One of the barrel portion and the end cap includes a socket, and the other of the barrel portion and the end cap includes a rounded head received within the socket to form a first pivot joint. The first pivot joint facilitates pivoting of the barrel portion with respect to the end cap upon impact with the ball.

This invention will become more fully understood from the following detailed description, taken in conjunction with the accompanying drawings described herein below, and wherein like reference numerals refer to like parts.

DETAILED DESCRIPTION OF EXAMPLES

Figure 1:
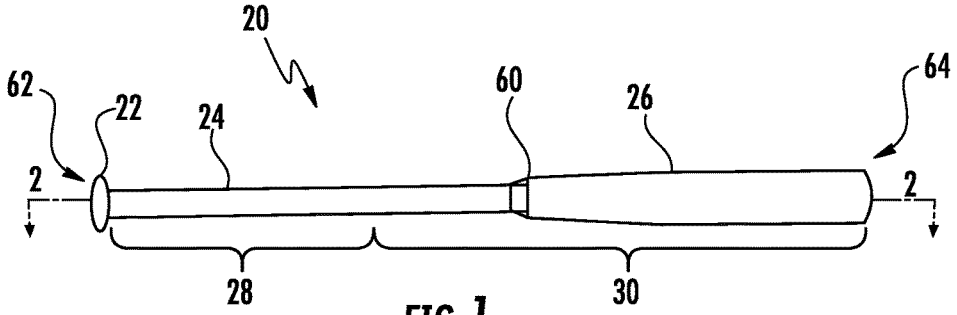
FIG. 1 is a side view of an example baseball or softball bat.
Figure 2:
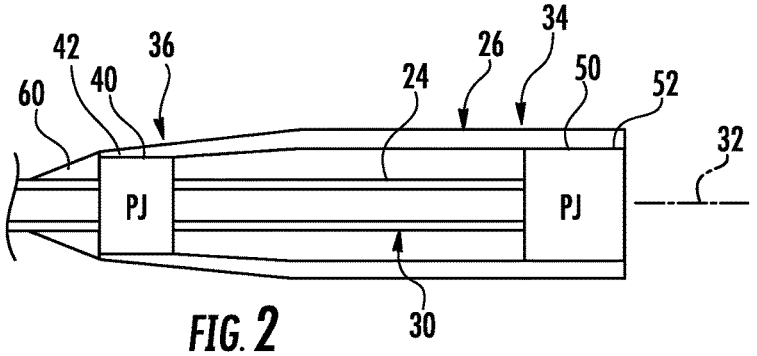
FIG. 2 is a fragmentary sectional view of a portion of the bat of FIG. 1.

FIGS. 1 and 2 illustrate an example baseball or softball bat 20. FIG. 2 is an enlarged fragmentary sectional view of a portion of bat 20. Bat 20 comprises a knob 22, a handle portion 24, a barrel portion 26, a pivot joint 40, a pivot joint 50 and a transitioner 60. As will be described hereafter, bat 20 has barrel portion 26 and a pivot joint 50 that pivotably supports a distal region of the barrel portion 26. The pivot joint 50 enhances deflection of the barrel portion 26 to enlarge the hitting zone or improve the performance of the barrel portion 26 as a whole, or in locations near the pivot joint 50.

Knob 22 extends at proximal end 62 of the handle portion 24 of the bat 20, and has a diameter wider than that of handle portion 24. In one implementation, knob 22 is coupled or directly attached to handle portion 24. In yet another implementation, knob 22 is integrally formed as a single unitary body with handle portion 24.

Handle portion 24 comprises elongate structure extending from knob 22 towards a distal end 64 of bat 20. Handle portion 24 has a proximal region 28 sized to be gripped by a batter's hands. Handle portion 24 has a distal region 30 connected to barrel portion 26. As shown by FIG. 2, in the example illustrated, handle portion 24 extends into barrel portion 26. In the example illustrated, handle portion 24 extends through a majority of the length of the barrel portion 26, centered along and about a centerline 32 or longitudinal axis of barrel portion 26 and of bat 20. In the example illustrated, handle portion 24 extends to a distal region 34 of barrel portion 26 where handle portion 24 is connected to the distal region 34 of barrel portion 26 by pivot joint 50. As will be described hereafter, in other implementations, handle portion 24 may terminate prior to reaching distal region 34 of barrel portion 26.

In the example illustrated, distal region 30 of handle portion 24 has a constant or uniform diameter along its length. In the example illustrated, handle portion 24 has a constant or uniform diameter along its entire length, including the proximal region 28 and distal region 30. The uniform or constant diameter of handle portion 24 facilitates fabrication or manufacturing of handle portion 24. In one implementation, handle portion 24 has an outer diameter of at least 0.5 inch and no greater than 1.25 inches. In yet other implementations, handle portion 24 may have other outer diameters. In other implementations, handle portion 24 may have a varying diameter along its length.

The handle portion 24 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof. As used herein, the terms "composite material" or "fiber composite material" refer to a plurality of fibers impregnated (or permeated throughout) with a resin. In one preferred embodiment, the fibers can be systematically aligned through the use of one or more creels, and drawn through a die with a resin to produce a pultrusion, as discussed further below. In an alternative preferred embodiment, the fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In other implementations, more than 8 layers can be used. In yet other implementations, the layers may be thinner, wherein the number of layers ranges from 20 to 30 layers, nominally 25 layers. In multiple layer constructions, the fibers can be aligned in different directions (or angles) with respect to the longitudinal axis 32 including 0 degrees, 90 degrees and angular positions between 0 to 90 degrees, and/or in braids or weaves from layer to layer. For composite materials formed in a pultrusion process, the angles can range from 0 to 90 degrees. In some implementations, the layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon, thermoplastic materials, rubber, other elastomeric materials, or combinations thereof. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, aramid, Spectra®, poly-para-phenylene-2,6-benzobisoxazole (PBO), hemp and combinations thereof. In one set of preferred embodiments, the resin is preferably a thermosetting resin such as epoxy or polyester resins.

Barrel portion 26 comprises an elongate hollow tubular member which provides a hitting zone or surface for bat 20. In one implementation, barrel portion 26 is formed from aluminum. In another implementation, barrel portion 26 may be formed from a fiber composite material. For example purposes only, one example composite barrel portion 26 may be manufactured by rolling multiple layers of parallelogram-shaped pieces of pre-preg, each layer having a height of about 0.005 inches (0.127 mm), onto a mandrel, thereby making a tube with an outer diameter appropriately sized for a ball bat barrel portion. The parallelograms can be rolled up such that each layer has a butt joint with itself and such that on one end all the layers stop at the same longitudinal station but on the other end, each layer can be about one centimeter shorter than the previous layer, creating a tapered end 16. In one implementation, the layers are angled +/−37 degrees from the longitudinal with each layer orientated at a negative angle to the previous layer. In other implementations, other lay-ups of composite materials with other angles and combinations of angles can be used. In still other implementations, barrel portion 26 can be formed of other materials, such as, for example, other alloys, wood, and combinations thereof.

Barrel portion 26 comprises distal region 34 and proximal region 36. In the example illustrated, distal region 34 has a generally constant diameter while proximal region 36 tapers inwardly from distal region 34 towards knob 22 and towards the outer surface of handle portion 24. In other implementations, distal region 34 and proximal region 36 may have other configurations. For example, the diameter of the barrel portion 26 may taper inward and/or outward continuously along its length.

The barrel portion 26 and handle portion 24 are capable of moving relative to each other about the pivot joints 40, 50, which are capable of dampening shock and vibration. Pivot joint 40 (schematically illustrated) movably supports proximal region 36 of barrel portion 26 for movement relative to axis 32. In the example illustrated, pivot joint 40 pivotably supports proximal region 36 for movement relative to axis 32 and for movement relative to handle portion 24. Upon impact with a ball with the barrel portion 26 at or near pivot joint 40, pivot joint 40 facilitates pivoting and deflection of proximal region 36 of barrel portion 26 about an axis that is perpendicular to axis 32.

Figure 15:
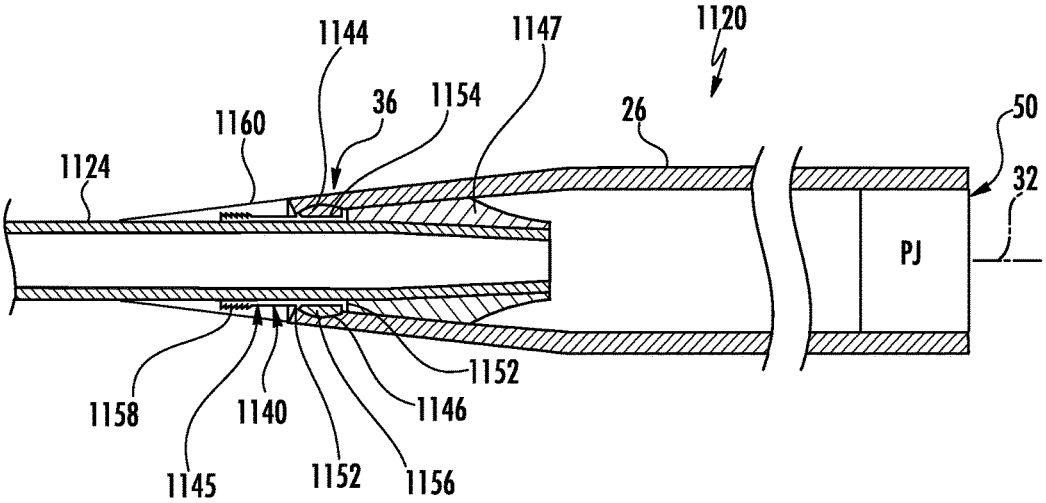
FIG. 15 is a longitudinal cross-sectional view of a portion of another example bat.

In one implementation, pivot joint 40 comprises a curved or annular socket formed into, or connected to, one of handle portion 24 and barrel portion 26 and a rounded head received within the curved or annular socket and connected to the other of handle portion 24 and barrel portion 26. In one implementation, as shown in FIG. 15 and discussed below, a metal sleeve or handle interface piece can be positioned over the handle to couple the pivot joint 40 to the handle portion 24. In one implementation, the curved or annular socket extends completely and continuously about axis 32. In another implementation, the curved or annular socket partially curves or extends about axis 32. In one implementation, pivot joint 40 may close off or occlude the proximal opening 42 of barrel portion 26, the annular volume or space between an interior of proximal region 36 of barrel portion 26 and the exterior surface of handle portion 24.

Pivot joint 50 (schematically illustrated) movably supports distal region 34 of barrel portion 26 relative to axis 32. In the example illustrated, pivot joint 50 pivotably supports distal region 34 of barrel portion 26 relative to axis 32. In one implementation, the pivot joint 50 is coupled to the distal region 34 of the barrel portion 26 by a tubular insert. The tubular insert can be formed of a plastic, a metal or other generally rigid material. Upon impact with a ball with the barrel portion 26 at or near pivot joint 50, pivot joint 50 facilitates pivoting and deflection of distal region 34 of barrel portion 26 about an axis that is perpendicular to axis 32. Pivot joint 50 cooperates with pivot joint 40 to pivotally support both ends of barrel portion 26, facilitating deflection of those regions between pivot joints 40 and 50 during impact with a ball. As a result, the hitting performance of the barrel can be enlarged and/or improved, particularly in locations of the barrel portion 26 at or near one or both of the pivot joints 40 and 50. In most conventional ball bats, the regions of the barrel portion adjacent the end cap of the bat or the region that is connected to, or continuous with, the handle portion, typically produce or provide limited or significantly reduced performance when impacting a ball at those locations. The present invention significantly improves the hitting performance (coefficient of restitution, trampoline effect, and feel) of the bat at or near those regions of the bat. Further, implementation of the first and second pivot joints serves to improve the performance of the barrel portion of the bat as a whole.

In one implementation, pivot joint 50 comprises a curved or annular socket connected to one of handle portion 24 and barrel portion 26 and a rounded head received within the curved or annular socket and connected to the other of handle portion 24 and barrel portion 26. In one implementation, the curved or annular socket extends completely and continuously about axis 32. In another implementation, the curved or annular socket partially curves or extends about axis 32. In one implementation, pivot joint 50 may be part of a structure or of the end cap that closes off or occludes the distal opening 52 of barrel portion 26. In yet other implementations in which handle portion 24 terminates prior to reaching distal region 34 of barrel portion 26 or is actually spaced from pivot joint 50, pivot joint 50 may be self-supporting, independent of handle portion 24. For example, as will be described hereafter, in some implementations, pivot joint 50 may comprise an end cap or other structure that extends about the interior surfaces of barrel portion 26 at distal region 34.

Transitioner 60 comprises a structure or a collection of multiple structures that provide a smooth transition from the larger diameter of the proximal region 36 of barrel portion 26 to the smaller diameter outer surface of handle portion 24. In one implementation, transitioner 60 comprises a conical sleeve extending about handle portion 24 insubstantial abutment with proximal edges of barrel portion 26. In yet another implementation, transitioner 60 comprises multiple components that collectively form a conical structure about handle portion 24 and in abutment with the proximal edge of barrel portion 26. In some implementations, transitioner 60 may be omitted. For example, in some implementations, barrel portion 26 may itself taper down to handle portion 24. In yet other implementations, a shoulder may exist between barrel portion 26 and handle portion 24. The transitioner 60 may be formed as primarily a cosmetic or aesthetic component of the bat. In other implementations, the transitioner can provide some degree of structural support, or provide mechanical dampening, to the bat or a pivot joint.

Figure 3:
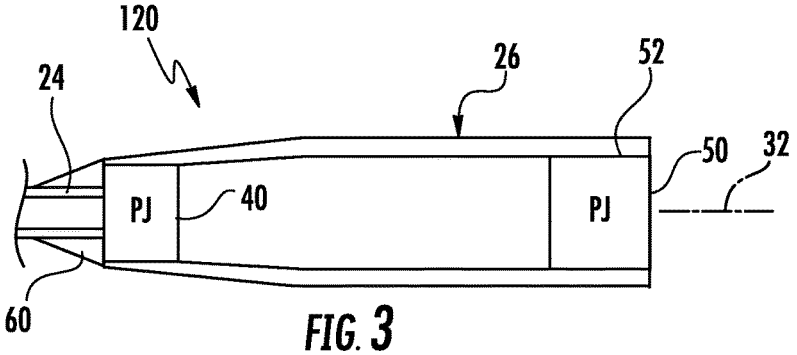
FIG. 3 is a fragmentary sectional view of a portion of another example bat.

FIG. 3 is a sectional view of bat 120, example implementation of bat 20. Bat 120 is similar to bat 20 except that handle portion 24 terminates prior to reaching pivot joint 50 such that pivot joint 50 is retained and supported independent of handle portion 24. In the example illustrated, handle portion 24 of bat 120 is connected to proximal region 36 of barrel portion 26 by pivot joint 40. The distal region of handle portion 24 is connected to pivot joint 40, whereas pivot joint 40 is connected to proximal region 36 of barrel portion 26. Pivot joint 50 occludes or closes distal opening 52 of barrel portion 26. In the example illustrated, the interior barrel portion 26 between pivot joint 40 and pivot joint 50 is hollow or unfilled by a pivot joint.

Figure 4:
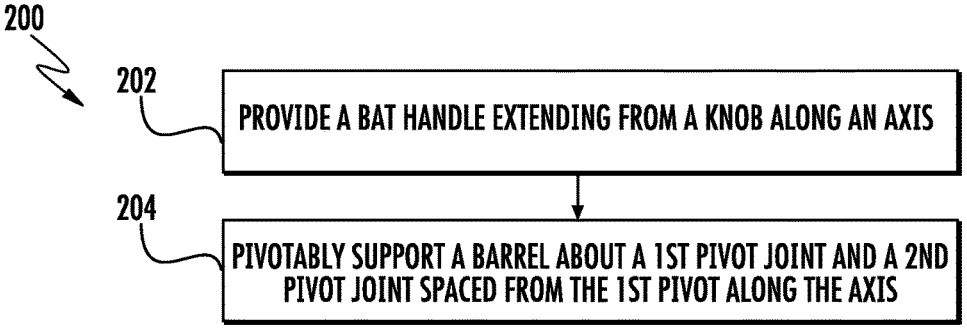
FIG. 4 is a flow diagram of an example method for forming an example bat.

FIG. 4 is a flow diagram of an example method 200 for forming a bat, such as bat 20 or bat 120 described above. As indicated by block 202, a bat handle portion extending from a knob along an axis is provided. As indicated by block 204, a barrel portion is pivotally supported about a first pivot joint and a second pivot joint spaced from the first pivot joint along the axis.

Figure 5:
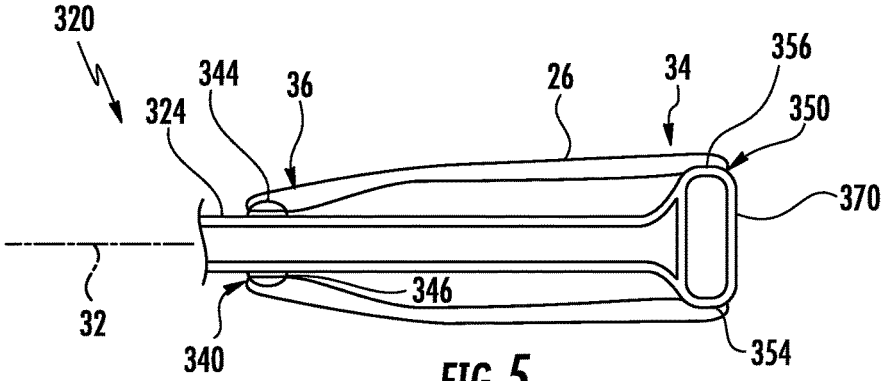
FIG. 5 is a fragmentary sectional view of a portion of another example bat.

FIG. 5 is an enlarged fragmentary sectional view of another example back 320, an example implementation of bat 20. Bat 320 similar to bat 20 except that bat 320 comprises handle portion 324 and is specifically illustrated as comprising pivot joints 340 and 350. Those remaining components of bat 320 which correspond to components of bat 20 or 120 are numbered similarly or are shown in FIGS. 1-3.

Handle portion 324 is similar to handle portion 24 except that handle portion 324 extends to and is connected to enlarged bulbous structure that also forms or serves as an end cap 370 for bat 320. End cap 370 is integrally formed as a single unitary body with handle portion 324. End cap 370 is contained within distal region 34 of barrel portion 26 such that distal region 34 overlays portions of end cap 370.

Pivot joint 340 is formed directly between proximal region 36 of barrel portion 26 and exterior surface of handle portion 324. In the example illustrated, pivot joint 340 comprises annular socket 344 and an annular rounded head 346 received within annular socket 344. In the example illustrated, annular socket 344 is provided by proximal region 36 of barrel portion 26 and rounded head 346 is provided on the exterior of handle portion 324. Rounded head 346 movable, slidably and/or rotatable engaged with socket 344, allowing proximal region 36 of barrel portion 26 to rotate or pivot about an axis (or axes) perpendicular to centerline 32 of bat 320 upon impact of a ball with the barrel portion 26. In other implementations, and annular socket 344 may be provided on the exterior of handle portion 324, facing outwardly, while rounded head 346 can be formed on the inner surface of proximal region 36 of barrel portion 26, facing and received within annular socket 344. In the example illustrated, both annular socket 344 and annular rounded head 346 completely and continuously encircle the axis or centerline 32. In another implementation, annular socket 344 and annular rounded head 346 may comprise multiple angularly spaced segments about axis 32.

Pivot joint 350 is formed by distal region 34 of barrel portion 26 and end cap 370. In the example illustrated, pivot joint 350 comprises annular socket 354 and an annular rounded head 356 of end cap 370 is received within annular socket 354. In the example illustrated, annular socket 354 is provided by distal region 34 of barrel portion 26 and rounded head 356 is provided on the circumferential perimeter of end cap 370. Rounded head 356 is movable, slidable and/or rotatable within socket 354, allowing distal region 34 of barrel portion 26 to rotate or pivot about an axis (or axes) perpendicular to centerline 32 of bat 320. In other implementations, annular socket 354 may be provided on the circumferential perimeter of end cap 370, facing outwardly, while rounded head 356 is formed on the inner surface of distal region 34 of barrel portion 26, facing and received within annular socket 344. In the example illustrated, both annular socket 354 and annular rounded head 356 completely and continuously encircle the axis or centerline 32. In another implementation, annular socket 354 and annular rounded head 356 may comprise multiple angularly spaced segments about axis 32. Because end cap 370 is integrally formed as a single unitary body with handle portion 324, both of such components may be simultaneously fabricated and assembled to barrel portion 26, providing simpler construction of bat 320.

Figure 6:
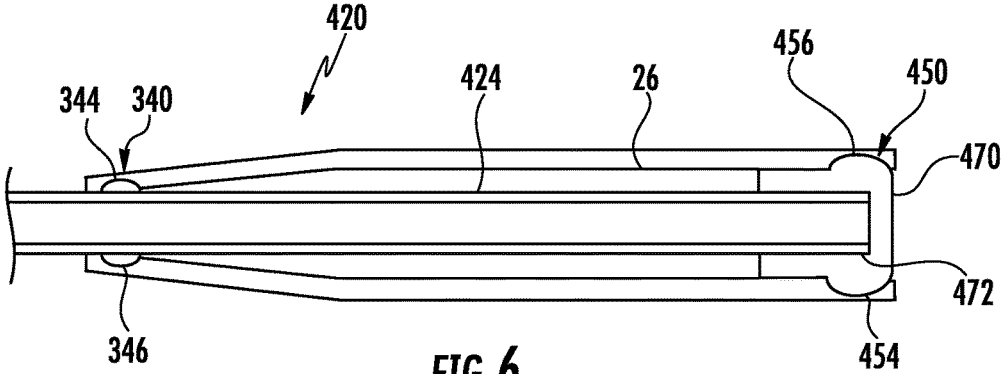
FIG. 6 is a fragmentary sectional view of a portion of another example bat.

FIG. 6 is an enlarged fragmentary sectional view of another example bat 420, an example implementation of bat 20. Bat 420 similar to bat 320 except that bat 420 comprises handle portion 424, end cap 470 and is specifically illustrated as comprising pivot joint 450. Those remaining components of bat 420 which correspond to components of bat 320 or bat 20 are numbered similarly or are shown in FIGS. 1-5.

Handle portion 424 is similar to handle portion 24 except that handle portion 424 is attached to end cap 470 for bat 420. Handle portion 424 has uniform diameter along its length to a distal end 472 received within end cap 470. In other implementations, distal end 472 may include an axial opening that receives a portion of end cap 470. End cap 470 is similar to end cap 370 except that end cap 470 is mounted to distal end 472 of handle portion 424. As a result, handle portion 424 may be more easily fabricated, such as a pultrusion, or other single diameter tubular body.

Pivot joint 450 is formed directly by distal region 34 of barrel portion 26 and end cap 470. In the example illustrated, pivot joint 450 comprises annular socket 454 and an annular rounded head 456 received within annular socket 454. In the example illustrated, annular socket 454 is provided by distal region 34 of barrel portion 26, and rounded head 456 is provided on the circumferential perimeter of end cap 470. Rounded head 456 is movable, slidable and/or rotatable within socket 454, allowing distal region 34 of barrel portion 26 to rotate or pivot about an axis (or axes) perpendicular to centerline 32 of bat 420. In other implementations, annular socket 454 may be provided on the circumferential perimeter of end cap 470, facing outwardly, while rounded head 456 is formed on the inner surface of distal region 34 of barrel portion 26, facing and received within annular socket 454. In the example illustrated, both annular socket 454 and annular rounded head 456 completely and continuously encircle the axis or centerline 32. In another implementation, annular socket 454 and annular rounded head 456 may comprise multiple angularly spaced segments about axis 32. Because end cap 470 is mounted to handle portion 424, both of such components may be individually fabricated and assembled together, reducing fabrication cost and complexity for each part.

Figure 7:
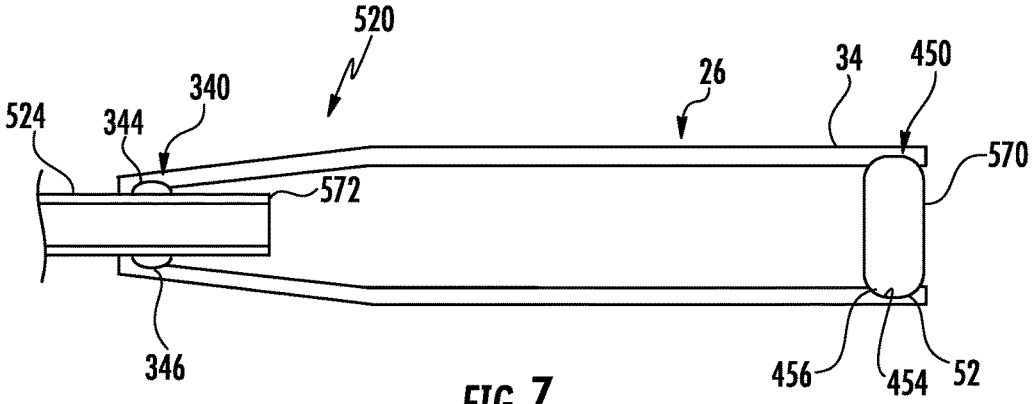
FIG. 7 is a fragmentary sectional view of a portion of another example bat.

FIG. 7 is an enlarged fragmentary sectional view of another example bat 520, an example implementation of bat 20. Bat 520 similar to bat 320 except that bat 520 comprises handle portion 524 and end cap 570. Those remaining components of bat 520 which correspond to components of bat 320 or bat 20 are numbered similarly or are shown in FIGS. 1-5.

Handle portion 524 is similar to handle portion 24 except that handle portion 524 terminates prior to reaching end cap 570. Handle portion 524 has uniform diameter along its length to a distal end 572 received within barrel portion 26. In one implementation, the distal end 572 of handle portion 524 can terminate in a tapered intermediate region of the barrel portion 26. In other implementations, the distal end 572 can terminate immediately following the rounded head 346, or any position along the longitudinal axis toward, but not extending to, the end cap 570.

End cap 570 is similar to end cap 470 except that end cap 570 comprises a disk that occludes distal opening 52 of barrel portion 26. In the example illustrated, the disk forming and 570 is within and is overlapped by distal region 34 of barrel portion 26. In the example illustrated, the outer circumferential perimeter of end cap 570 provides the annular rounded head 456 while the inner surface of distal portion 34 provides the inner annular groove 454 of pivot joint 450. In other implementations, the outer circumferential perimeter of end cap 570 may alternatively comprise an outer annular groove or socket 454 of pivot joint 450 while the inner circumferential surface of distal portion 34 of barrel portion 26 comprises the annular rounded head 456 of pivot joint 450.

Figure 8:
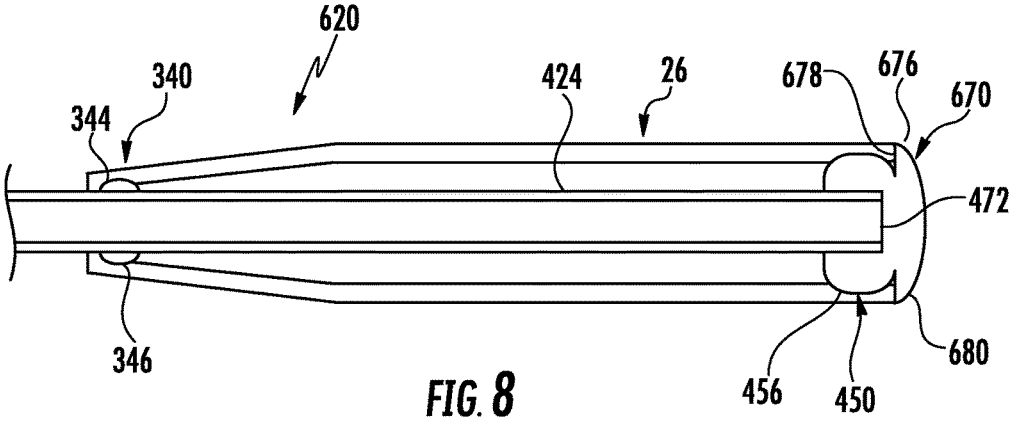
FIG. 8 is a fragmentary sectional view of a portion of another example bat.

FIG. 8 is an enlarged fragmentary sectional view of another example bat 620, an example implementation of bat 20. Bat 620 similar to bat 420 except that bat 620 comprises end cap 670. Those remaining components of bat 620 which correspond to components of bat 420 or bat 20 are numbered similarly or are shown in FIGS. 1-6.

End cap 670 is similar to end cap 470 in that end cap 670 receives distal end 472 of handle portion 424. End cap 670 is different from end cap 470 in that end cap 670 additionally comprises a cover portion or lip 676. Lip 676 radially projects away from axis 32 so as to extend across, cover and overlie distal edges 678 of barrel portion 26. Lip 676 protects distal edges 678 of barrel portion 26. In one implementation, lip 676 is formed from an elastomeric material. In other implementations, other materials or combinations of materials can be used to make the end cap. In one implementation, lip 676 is connected to the distal edges 678 of barrel portion 26, but flexes so as to permit to pivoting of pivot joint 450 about an axis (or axes) perpendicular to axis 32, about rounded head 456, in response to the impact of a ball against barrel portion 26. In the example illustrated, lip 676 has a rounded perimeter 680. In other implementations, perimeter 680 may be tapered or may have other shapes. In another implementation, the handle portion 424 may terminate after the first pivot joint 340 and not extend to the end cap 670.

Figure 9:
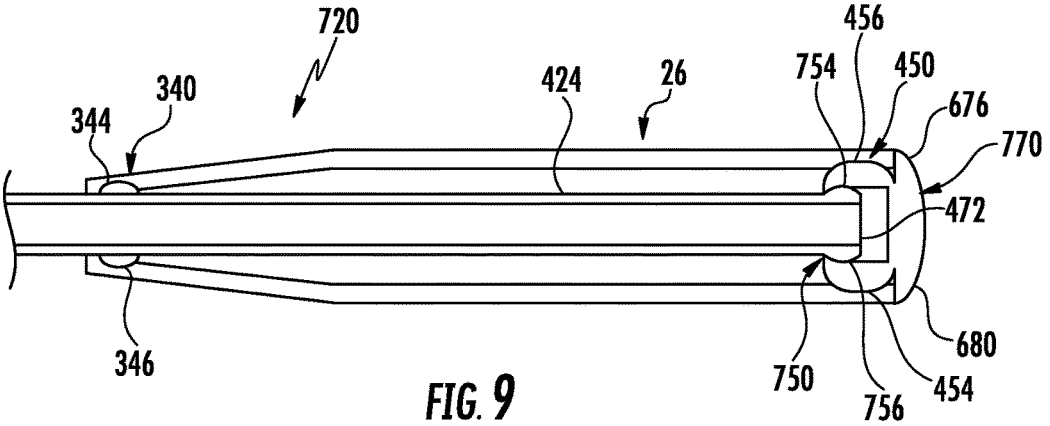
FIG. 9 is a fragmentary sectional view of a portion of another example bat.

FIG. 9 illustrates bat 720, another example implementation of bat 20. Bat 720 similar to bat 620 except that bat 720 additionally comprises pivot joint 750. Those remaining components of bat 720 which correspond to components of bat 620 or bat 20 are numbered similarly or are shown in FIGS. 1-2 and 8.

Pivot joint 750 is formed directly by an interior of end cap 770 and exterior surface of handle portion 424. In the example illustrated, pivot joint 750 includes annular socket 454 formed into the distal region of the barrel portion 26 and annular rounded head 456 formed by outer peripheral surfaces of end cap 770 (essentially incorporating pivot joint 450). Pivot joint 750 also comprises annular socket 754 and an annular rounded head 756 received within annular socket 754. In the example illustrated, annular socket 754 is provided by an interior portion of end cap 770 and rounded head 756 is provided on the exterior of handle portion 424 adjacent distal end 472. Rounded head 756 is movable, slidable and/or rotatable within socket 754, further allowing distal region 34 of barrel portion 26 to rotate or pivot about an axis (or axes) perpendicular to centerline 32 of bat 320. In other implementations, annular socket 754 may be provided on the exterior of handle portion 424 adjacent distal end 472, facing outwardly, while rounded head 756 is formed on the inner surface of end cap 770, facing and received within annular socket 754. In the example illustrated, both annular socket 754 and annular rounded head 756 completely and continuously encircle the axis or centerline 32. In another implementation, annular socket 754 and annular rounded head 756 may comprise multiple angularly spaced segments about axis 32. Pivot joint 750 essentially combines a pair of radially spaced apart annular sockets 454 and 754 with a pair of annular rounded heads 456 and 756.

Figure 10:
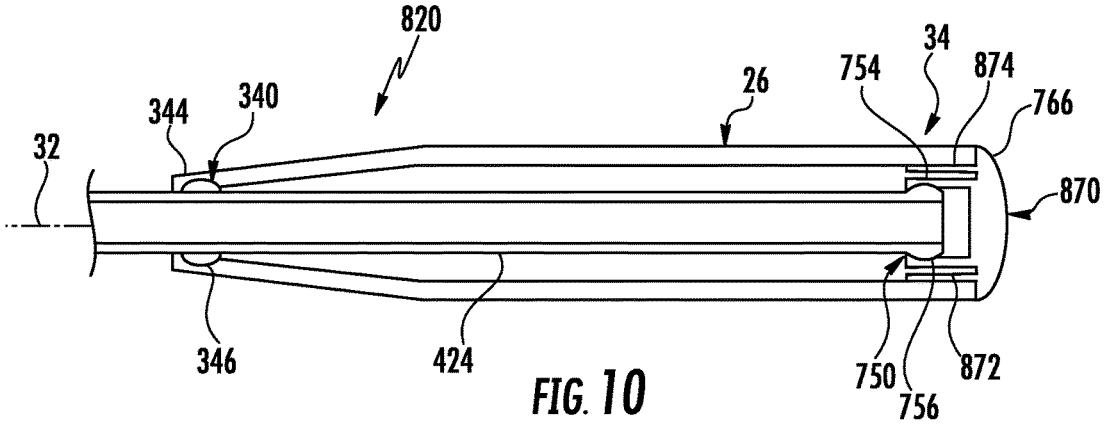
FIG. 10 is a fragmentary sectional view of a portion of another example bat.

FIG. 10 illustrates bat 820, another example implementation of bat 20. Bat 820 is similar to bat 720 except that bat 820 comprises end cap 870 and omits pivot joint 450, utilizing pivot joint 750 to facilitate pivoting of the distal region 34 of barrel portion 26 during impact with a ball. Those remaining components of bat 820 which correspond to components of bat 720 or bat 20 are numbered similarly or are shown in FIGS. 1-2 and 9.

End cap 870 caps the end of barrel portion 26 the same time permitting barrel portion 26 to pivot about pivot joint 750 when impacted by a ball. End cap 870 comprises an annular ring 872 that fits inside distal region 34 of barrel portion 26 and abuts the inner circumferential surfaces 874 of distal region 34 of barrel portion 26 to secure end cap 870 to barrel portion 26. In one implementation, ring 872 frictionally engages the inner surfaces 874 of barrel portion 26 to retain end cap 870 in place. In another implementation, ring 872 is glued, bonded, welded, fastened or snapped to surface 874 of barrel portion 26. In the example illustrated, ring 872 is formed from a resiliently flexible material, being sufficiently flexible to allow bat 26 to pivot about an axis perpendicular to centerline 32 as facilitated by pivot joint 750.

Figure 11:
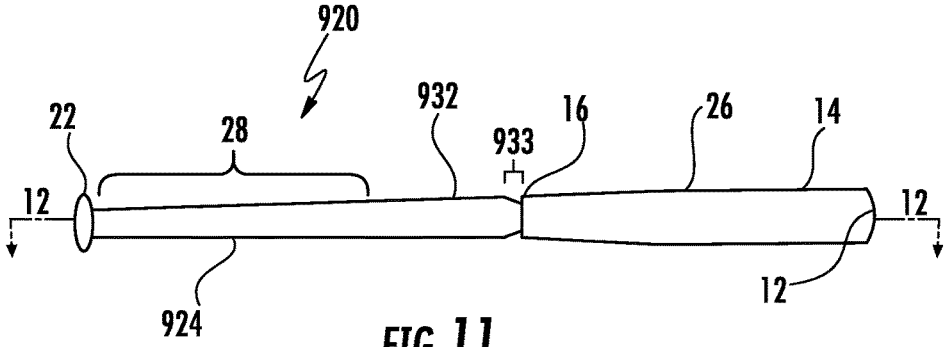
FIG. 11 is a side view of another example bat.
Figure 12:
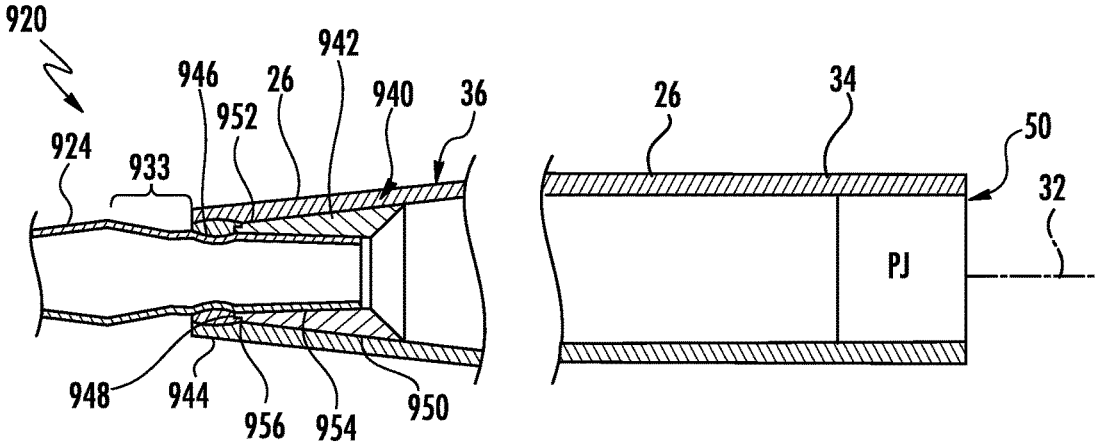
FIG. 12 is a fragmentary sectional view of a portion of the bat of FIG. 11.

FIGS. 11 and 12 illustrate bat 920, another example implementation of bat 20. Bat 920 is similar to bat 20 described above except that bat 920 is specifically illustrated as comprising handle portion 924, pivot joint 940 and wedge 942. Those remaining components of bat 920 which correspond to points of bat 20 are numbered similarly. Bat 920 also includes a second pivot joint, such as pivot joint 50, 350 or 450, position at the distal region 34 of the barrel portion 26 and the end cap, such as end cap 370, 470, 570, 670, 770 or 870.

Handle portion 924 is similar to handle portion 24 except that handle portion 924 comprises a distal region 932 that initially expands as handle portion 924 extends towards barrel portion 26 and then tapers inwardly in the region 933 as handle portion 924 extends into barrel portion 26. In yet other implementations, handle portion 924 may have a constant diameter along its length.

Pivot joint 940 pivotably supports proximal region 36 of barrel portion 26 for pivotal movement about an axis perpendicular to the centerline 32 of bat 920. Pivot joint 940 cooperate with pivot joint 50 (schematically illustrated) to facilitate inward deflection of barrel portion 26 when impacting a ball, enhancing or improving the performance of the barrel portion and the hitting zone of the ball bat.

As shown in FIG. 12, pivot joint 940 comprises an annular socket 944 and an annular rounded head 946 which is movably received within socket 944. In the example illustrated, socket 944 is formed along the inner surface of barrel portion 26 while rounded head 946 is provided on the exterior of handle portion 924. In other implementations, this arrangement may be reversed.

In one implementation, socket 944 is pre-molded into a generally toroidal shape with a central channel or groove sized to snugly accept the rounded head 946 of handle portion 924. In one embodiment, the socket 944 has an outer diameter of about 1.25 inches (3.18 cm), an inner diameter of about 0.87 inches (2.29 cm), and a length of about 0.55 inches (1.40 cm). The outer curve of the socket 944 is a segment of a circle with a diameter of 1.26 inches (3.20 cm). The inner curve of the socket 944 is a segment of a circle with a diameter of 0.98 inches (2.49 cm). The height of the socket varies from about 0.19 inches (4.83 mm) at the center to about 0.07 inches (1.78 mm) at the edges. In the example illustrated by FIG. 12, the socket 944 includes a notch 948. The notch 948 has a length of about 0.1 inches (2.54 mm) and a height of about 0.04 inches (1.02 mm). The socket 944 may be made of any suitable material, such as, for example, a hard nylon.

Wedge 942 comprises a structure extending between the outer circumference of handle portion 924 and the inner circumference of barrel portion 26. In one implementation, wedge 942 pre-molded into a truncated, generally conical shape having a large diameter end 950 and a small diameter end 952. The wedge 942 includes a central channel 954 sized to snugly accept the handle portion 924. In the example shown in FIG. 12, the tapered proximal region 36 of the barrel portion 26 includes a notch 956 for facilitating retention and proper positioning of rounded head 946 and wedge 942.

In one implementation, the length of the wedge 942 is about 2 inches (5.08 cm). The small diameter end 952 of wedge 942 has a diameter of about 1.1 inches (2.79 cm). The diameter of the wedge 942 remains constant for a length of 0.1 inches (2.54 mm), extending over the length of the notch 40, and then increases along a curve with a radius of 0.05 inches (1.27 mm) to a diameter of 1.2 inches (3.05 cm). The diameter of the wedge 942 then increases at a 6.5 degree angle to a diameter of about 1.70 inches (4.32 cm) at the large diameter end 950. The central channel 954 has a 1 inch (2.54 cm) diameter at the small diameter end 952, which decreases in diameter at a 5 degree angle for a length of about 0.57 inches (1.45 cm) to a diameter of 0.9 inches (2.29 cm). The central channel 42 maintains a constant diameter of 0.9 inches (2.29 cm) for a length of about 1.08 inches (2.74 cm), then increases in diameter at a 45 degree angle for a length of about 0.35 inches (8.9 mm) to the large diameter end 36. In other implementations, the wedge 942 can be formed of other shapes and/or sizes. In this embodiment, the outer surface of the wedge 942 corresponds with the inner surface of the transition region 933 of the ball bat 920. The wedge 942 may be made of any suitable material, such as, for example, rubber, or preferably, ethylene propylene diene monomer ("EPDM") rubber with a hardness between 40-50 Shore A, ideally about 45 Shore A. In other implementations, the wedge 942 can be formed of other materials, such as a polymeric foam, and can be formed of other hardness values.

In one implementation, the pivot joint 940 is made by attaching the socket 944 to the small diameter end 952 of the wedge 942 such that the handle portion 924 fits inside the central channel 954 of the socket 944 and the central channel 954 of the wedge 942. The wedge 942 may be secured to the socket 944 by any suitable method, such as, for example bonding with an adhesive.

In another implementation, handle portion 924 can be formed as a substantially constant diameter hollow tube. The handle portion 924 may be manufactured using common manufacturing techniques.

For example purposes only, a composite handle portion 924 may be made by rolling at least one flat sheet of pre-impregnated composite fiber ("pre-preg") around a mandrel, thereby making a tube with an outer diameter appropriately sized for a ball bat handle portion. In a preferred embodiment, the sheet of pre-preg comprises two layers of graphite pre-preg with fibers angled +/−15 degrees from the longitudinal with one layer orientated at a negative angle to the other layer. Two layers of pre-preg with a height of about 0.005 inches (0.127 mm) and fibers angled 90 degrees from the longitudinal are wrapped around the last 7.87 inches (20.0 cm) of the handle portion 924 at the end opposite the knob 22. In other implementations, other composite materials or other materials can be used to form the handle portion.

For example purposes only, a composite barrel portion 26 may be manufactured by spirally rolling 24 layers of high aspect ratio parallelogram-shaped pieces of pre-preg, each layer having a height of about 0.005 inches (0.127 mm), on a rolling mandrel with the fibers oriented longitudinally, thereby making a tube with an outer diameter appropriately sized for a ball bat barrel portion. A finishing mandrel includes a constant diameter section and a tapered section. After being rolled up, the barrel portion 26 is transferred to the constant diameter section of the finishing mandrel. The socket assembly 940 is temporarily attached to the finishing mandrel by affixing the large diameter end 950 of the wedge 942 to the end of the tapered section of the finishing mandrel. Latex banding about one inch (2.54 cm) wide and 0.05 inches (1.27 mm) high is wrapped around the tapered end 16 of the barrel portion 14. The proximal region 36 is then slowly drawn down the tapered section of the finishing mandrel, over the wedge 942 and over the socket 944, such that the proximal region 36 stops at the same longitudinal station as the socket 944. The latex banding is then removed and ribbons of pre-preg about 0.5 inches (1.27 cm) wide are wound around the lay-up directly above the pivot joint 940, forming a thickness of about 20 layers of pre-preg, each layer having a height of about 0.005 inches (0.127 mm). By being formed directly over the pivot joint 940, the inner surface of the barrel portion 26 is contoured to retain pivot joint 940.

The barrel portion 26 is removed from the finishing mandrel and a portion of the handle portion 924 is inserted. The handle portion 924 contacts the socket 944 and wedge 942 of the pivot joint 940, but does not contact the barrel portion 26, as shown in FIG. 12. The handle portion 924 is retained within the socket 944 and wedge 942 by mechanical interference. In some embodiments, the handle portion 924 may be attached to the wedge 942, such as, for example, by bonding with an adhesive. The barrel portion 26 and handle portion 924 are capable of moving relative to each other about the socket 944, which dampens shock and vibration. The wedge 942 is located between the barrel portion 26 and handle portion 924, restricting the relative movement between the handle portion 924 and barrel portion 26. The degree of restriction of relative movement between the handle portion 924 and barrel portion 26 can be controlled by selecting the thickness of the wedge 942 and the material from which the wedge 942 is constructed.

The exterior surfaces of the barrel portion 26 and handle portion 924 do not provide a substantially continuous and smooth surface for the outer surface of the transition region 933. Instead, a generally triangular shaped notch is formed in the transition region 933 of the ball bat 920. The notch 933 is perpendicular to the long axis of the ball bat 920 and formed at a station whereby the notch 933 is adjacent to the socket 944. The notch 933 has a maximum depth of about 0.25 inches (6.35 mm) adjacent to the socket 944, with the depth of the notch 933 decreasing in the direction of the knob 22. The notch 933 allows for greater relative movement between the handle portion 924 and the barrel portion 26.

An inflatable bladder is inserted into the ball bat 920 assembly and a standard knob 22 is applied using techniques common in the industry. The bladder is inflated, expanding the barrel portion 26 and handle portion 924. The expansion of the handle portion 924 causes the outer surface of the handle portion 924 to conform to the inner surface of the socket 944 and wedge 950. In particular, the handle portion 924 forms a concave "saddle" shape conforming to the inner surface of the socket 944 which mechanically locks the handle portion 924 within the barrel portion 26. The assembly then is placed into a ball bat-shaped mold under pressure and heated to cure the ball bat, using standard techniques known in the art. Both the handle portion 924 and barrel portion 26 are cured at the same time, consequently only one composite cure cycle is utilized for the ball bat 920.

Figure 13:
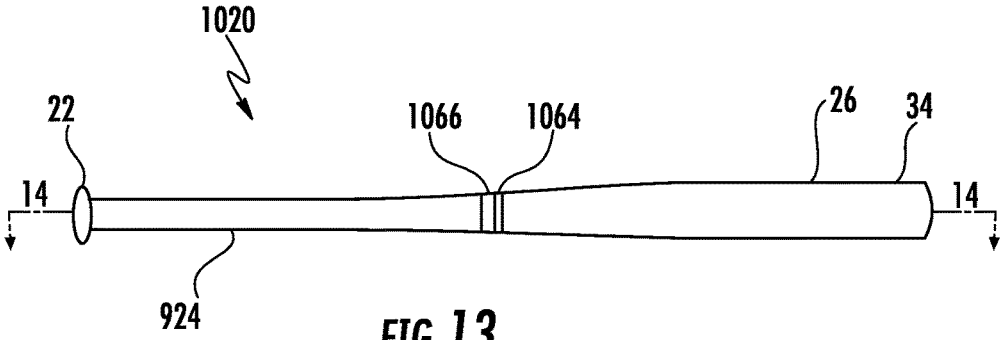
FIG. 13 is a side view of another example bat.
Figure 14:
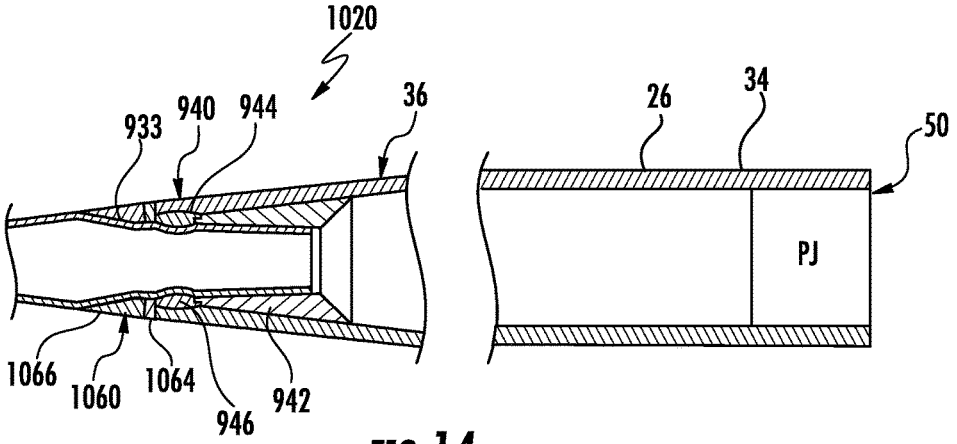
FIG. 14 is a fragmentary sectional view of a portion of the bat of FIG. 13.

FIGS. 13 and 14 illustrate bat 1020, another example implementation of bat 20. That 1020 is similar to bat 920 except that bat 1020 additionally comprises transitioner 1060. Those remaining components of bat 1020 which correspond to components of bat 920 are numbered similarly.

Transitioner 1060 comprises ring 1064 and filler material 1066. Ring 1064 coaxially placed around the handle portion 924, in the notch 933, such that the ring 1064 abuts the socket 944 and the proximal region 36 of the barrel portion 26. The height of the ring 1064 is preferably equal to the depth of the notch 933 and the width of the ring is about 0.212 inches (5.38 mm). The ring 1064 may be made of any suitable material, such as, for example, rubber, or preferably, EPDM rubber with a hardness between 40-50 Shore A, ideally about 45 Shore A. In one implementation, the ring 1064 is constructed from the same material as the wedge 942. In yet other implementations, ring 1064 and wedge 942 are formed from different materials. For example, in one implementation, ring 1064 may be formed from a silicone rubber, whereas wedge 942 may be formed from an ethylene propylene diene monomer (EPDM) synthetic rubber, a thermoplastic polyurethane (TPU), a thermoplastic elastomer blends.

The ring 1064 acts cooperatively with the wedge 942 to restrict the relative movement between the handle portion 924 and barrel portion 26 about the socket 944. The degree of restriction of relative movement between the handle portion 20 and barrel portion 14 can be controlled by modifying the material from which the ring 1064 is constructed. The remaining volume of the notch 933 may be filled with a fill material 1066, such as, for example, adding sufficient pre-preg to fill the remaining volume of the notch 933 before the cure cycle. In this preferred second embodiment, the notch 933 is filled by ring 1064 and fill material 1066 such that the barrel portion 26, ring 1064, fill material 1066, and handle portion 924, provide a substantially continuous and smooth exterior surface for the transition region of the ball bat 1020.

FIG. 15 illustrates bat 1120 another example implementation of bat 20. Bat 1120 comprises knob 22 (shown in FIG. 1), handle portion 1124, barrel portion 26 (shown in FIG. 1), pivot joint 1140, pivot joint 50 and transitioner 1160. Handle portion 1124 extends between knob 22 and barrel portion 26. In the example illustrated, handle portion 1124 has a constant outer diameter along a majority, if not all of its length. Handle portion 1124 projects into barrel portion 26. In other implementations, handle portion 1124 may have other configurations.

Pivot joint 1140 pivotably supports proximal region 36 of barrel portion 26 for pivotal movement about an axis perpendicular to the centerline 32 of bat 1120. Pivot joint 1140 cooperates with pivot joint 50 (schematically illustrated) to facilitate inward deflection of barrel portion 26 when impacting a ball, enhancing or improving the performance of the barrel portion and the hitting zone of the ball bat.

As shown in FIG. 15, pivot joint 1140 comprises an annular socket 1144, handle interface piece 1145, annular rounded head 1146 which is movably received within socket 1144 and damper 1147. In the example illustrated, socket 1144 is formed along the inner surface of barrel portion 26 while rounded head 1146 is coupled to the exterior of handle portion 1124. In other implementations, this arrangement may be reversed.

Handle interface piece (HIP) 1145 comprises a component that is bonded to the outer diameter an outer surface of handle portion 1124. HIP 1145 interconnects handle portion 1124 to barrel portion 26. In the example illustrated, HIP 1145 comprises an a tube or sleeve having a pair of spaced walls 1152 that form an intermediate channel 1154 that contains a ring 1156 having an outer rounded surface forming head 1146. In other implementations, ring 1156 may be secured to hip 1145 without being received within the intermediate channel 1154. For example, ring 1156 may be welded, bonded, mechanically snapped into or onto, or otherwise secured to HIP 1145. In some implementations, ring 1156 is omitted, wherein head 1146 is integrally formed as a single unitary body about along the exterior of HIP 1145.

In the example illustrated, the outer surface of HIP 1145 additionally includes a threaded portion 1158. Threaded portion 1158 threadably mates with corresponding threads on the interior of interface 1160. Similar to interface 60, interface 1160 provides a smooth transition between handle portion 1124 and barrel portion 26. In other implementations, HIP 1145 may omit threaded portion 1158, wherein interface 1160 is secured to handle portion 1124 and/or HIP 1145.

Damper 1147 comprises an elastomeric or resilient mass of material captured between handle portion 1124 and the interior diameter service of barrel portion 26 within barrel portion 26. In one implementation, damper 1147 comprises a mass of rubber or rubber-like material filling the volume between the proximal region 36 of barrel portion 26, mechanically coupled to or physically contacting the inner surface of barrel portion 26 and the outer surface of handle portion 1124. In one implementation, damper 1147 is formed by filling the volume between HIP 1145 and the end of handle portion 24 with elastomeric material or rubber-like material in a liquid like state, wherein the elastomeric or rubber-like material is subsequently dried or cured to a solid-state. In yet another implementation, damper 1147 is formed by securing a tubular rubber-like sleeve about the portion of handle portion 1124 that is received within barrel portion 26. Damper 1147 absorbs vibration and shock as barrel portion 26 pivots about one or both of pivot joint 1140 and pivot joint 50.

Although each of FIGS. 1-15 illustrate example bats in which each bat has a pivot joint proximate to both opposite ends of the barrel, each of such bats may alternatively comprise a single pivot joint at the distal end of the bat. Although each of FIGS. 1-15 illustrate bats which are multi-piece bats having distinct handle and barrel portions or members which are joined or secured to one another, in other implementations, each of such bats may alternatively be formed as "one piece" bat, a bat in which the handle and the barrel are integrally formed as a single unitary body. Such "one piece" bats may each have a single pivot joint or two opposite pivot joints.

Figure 16:
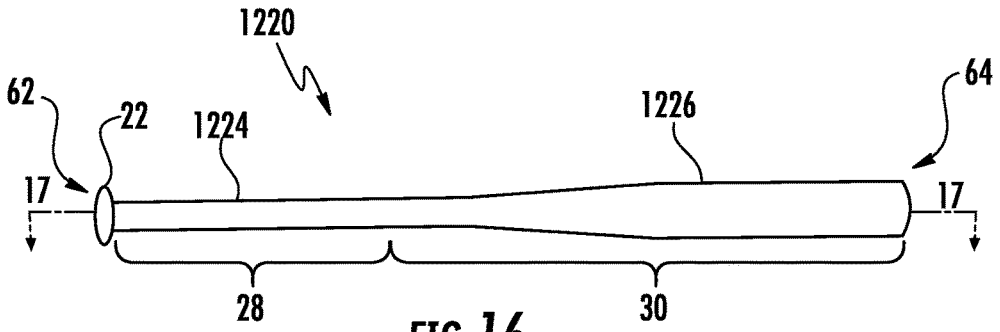
FIG. 16 is a side view of another example bat.
Figure 17:
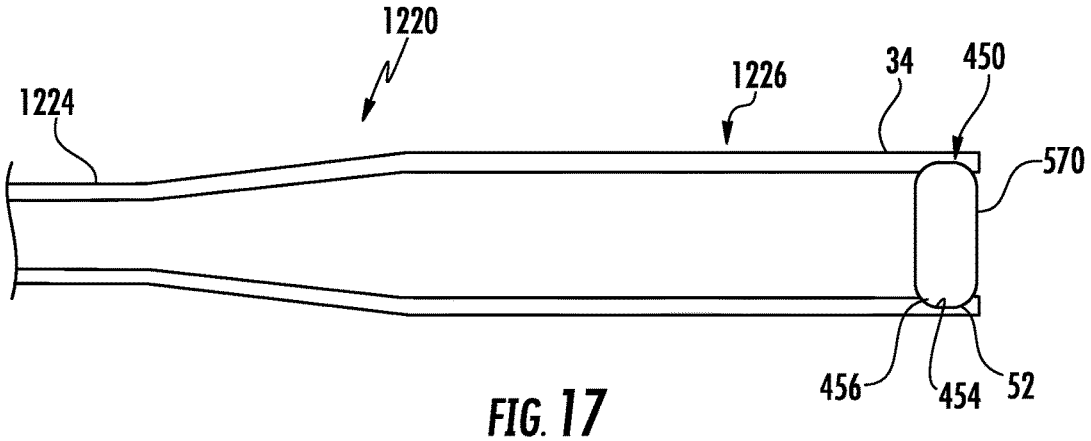
FIG. 17 is a fragmentary sectional view of a portion of the example bat of FIG. 16.

FIGS. 16 and 17 illustrate another example bat 1220. Bat 1220 is similar to bat 520 shown in FIG. 7 except that bat 1220 comprises a "one-piece" bat which a single member provides both the handle and the barrel of the bat. Those components of bat 1220 which correspond to components of bat 520 are numbered similarly.

As shown by FIG. 16, bat 1220 continuously extends from knob 22 to endcap 570 without interruption. As shown by FIG. 17, bat 1220 has a single outer layer that form both the handle portion 1224 and the barrel portion 1226 of bat 1220. In other implementations, and a portion 1224 and barrel portion 1226 may be formed from multiple overlapping layers that continuously extend from knob 22 to endcap 570.

As further shown by FIG. 17, bat 1220 has a single pivot joint 450 at the distal and of the bat, the end of the bat most distant the knob 22. In the example illustrated, end cap 570 (described above with respect to bat 520) has a rounded circumferential periphery or head 454 that is movably received within an annular interior socket 456. As a result, the outer walls of barrel portion 1226 may pivot about head 454 during impact with a ball.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A ball bat extending along a longitudinal axis, the bat comprising: a handle portion; a barrel portion including a proximal region and a distal region, the proximal region of the barrel portion coupled to the handle portion by a first pivot joint; and an end cap, the distal region of the barrel portion coupled to the end cap by a second pivot joint, the first and second pivot joints movably supporting the barrel portion relative to the longitudinal axis such that the distal region of the barrel portion may pivot towards and away from the longitudinal axis about the second pivot joint; wherein the second pivot joint comprises one of an annular socket coupled to one of the barrel portion and the end cap, and a rounded, bulbous head coupled to the other of the barrel portion and the end cap while being received within the annular socket.

2. The ball bat of claim 1, wherein the annular socket extends along an interior of the barrel portion and wherein the end cap comprises the rounded, bulbous head.

3. The ball bat of claim 2, wherein the rounded, bulbous head is axially spaced from the handle portion.

4. The ball bat of claim 2, wherein the end cap comprises:

a cover portion extending from the rounded, bulbous head over distal edges of the barrel portion; and an inner annular socket receiving an outer annular head coupled to the handle portion to form the second pivot joint.

5. The ball bat of claim 3, wherein the end cap further comprises a cover portion extending from the rounded, bulbous head over distal edges of the barrel portion.

6. The ball bat of claim 1, wherein the handle portion extends through the barrel portion into engagement with the end cap.

7. The ball bat of claim 1, wherein the proximal region of the barrel portion includes a first annular socket, wherein a first rounded, bulbous head is coupled to the handle portion, and wherein the first annular socket and the first rounded, bulbous head form the first pivot joint.

8. The ball bat of claim 7, further comprising a wedge extending between an outer circumference of the handle portion and an inner circumference of the proximal region of the barrel portion.

9. The ball bat of claim 8, wherein the handle portion extends into the wedge, wherein the proximal end of the barrel portion overlays the wedge and a distal end of the handle portion.

10. The ball bat of claim 1, wherein the rounded, bulbous head comprises an inner annular socket receiving a rounded bulbous annular head coupled to the handle portion.

11. The ball bat of claim 10, wherein the end cap further comprises a peripheral portion extending from the rounded, bulbous head over axial edges of the barrel portion.

12. The ball bat of claim 1, wherein the end cap further comprises a cover portion extending from the rounded, bulbous head over distal edges of the barrel portion.

13. The ball bat of claim 1, wherein the handle portion extends into and within the barrel portion, the handle portion having a constant diameter along its length.

14. The ball bat of claim 1 further comprising a transition member having an outer surface tapering from the barrel portion to the handle portion.

15. The ball bat of claim 1, wherein the proximal region of the barrel portion overlays the first pivot joint and the distal region of the barrel portion overlays the second pivot joint.

16. The ball bat of claim 1, wherein the second pivot joint pivotably supports the second distal region of the barrel portion about a second axis perpendicular to the longitudinal axis.

17. The ball bat of claim 16, wherein the first pivot joint pivotably supports the proximal region of the barrel portion about a third axis perpendicular to the longitudinal axis.

18. The ball bat of claim 1, wherein the first pivot joint comprises:

a curved concave surface facing a side of the longitudinal axis; and a curved convex surface away from the side of the longitudinal axis and abutting the curved concave surface.

19. The ball bat of claim 2, wherein the second pivot joint comprises:

a curved concave surface facing a side of the longitudinal axis; and a curved convex surface facing away from the side of the longitudinal axis and abutting the curved concave surface.

20. The ball bat of claim 1, wherein the annular socket comprises a concave channel annually extending around the longitudinal axis, the concave channel receiving the rounded, bulbous head.

21. A ball bat for impacting a ball, the bat comprising: a handle portion extending along a longitudinal axis; a barrel portion coupled to, and extending from, the handle portion; and an end cap, wherein one of the barrel portion and the end cap comprises a socket, and wherein the other of the barrel portion and the end cap comprises a rounded, bulbous head received within the socket to form a first pivot joint to facilitate pivoting of the barrel portion with respect to the end cap, about the first pivot joint, towards and away from the longitudinal axis, upon impact with the ball; a second pivot joint between the barrel portion and the handle portion.

* * * * *